US006198265B1

(12) United States Patent
Stevenson

(10) Patent No.: US 6,198,265 B1
(45) Date of Patent: Mar. 6, 2001

(54) FIXED FREQUENCY SWITCHING REGULATOR WITH IMPROVED DYNAMIC RESPONSE

(75) Inventor: Brian Keith Stevenson, Lake Forest, CA (US)

(73) Assignee: Unisem, Inc., Irvine, CA (US)

( * ) Notice: Subject to any disclaimer, the term of this patent is extended or adjusted under 35 U.S.C. 154(b) by 0 days.

(21) Appl. No.: 09/099,998

(22) Filed: Jun. 19, 1998

(51) Int. Cl.[7] ..... G05F 1/575
(52) U.S. Cl. ..... 323/288; 363/95
(58) Field of Search ..... 323/282, 288, 323/351; 363/95, 97

(56) References Cited

U.S. PATENT DOCUMENTS

| | | | | |
|---|---|---|---|---|
| 4,302,803 | | 11/1981 | Shelly . | |
| 5,142,217 | * | 8/1992 | Gontowski | 323/272 |
| 5,233,509 | | 8/1993 | Ghotbi . | |
| 5,264,780 | * | 11/1993 | Bruer et al. | 323/288 |
| 5,283,515 | * | 2/1994 | Jordan | 323/288 |
| 5,291,384 | * | 3/1994 | Mammano et al. | 363/98 |
| 5,335,162 | * | 8/1994 | Martin-Lopez et al. | 363/97 |
| 5,404,094 | | 4/1995 | Green et al. . | |
| 5,414,342 | | 5/1995 | Mammano et al. . | |
| 5,436,550 | * | 7/1995 | Arakawa | 323/288 |
| 5,489,831 | | 2/1996 | Harris . | |
| 5,572,108 | * | 11/1996 | Windes | 320/1 |
| 5,592,128 | * | 1/1997 | Hwang | 323/288 |
| 5,627,460 | * | 5/1997 | Bazinet et al. | 323/288 |
| 5,644,214 | * | 7/1997 | Lee | 323/288 |
| 5,659,460 | * | 8/1997 | Vinciarelli | 363/97 |
| 5,687,067 | * | 11/1997 | Majid et al. | 363/97 |
| 5,757,173 | * | 5/1998 | Agiman | 323/282 |
| 5,757,214 | * | 5/1998 | Stoddard et al. | 323/282 |
| 5,768,118 | * | 6/1998 | Faulk et al. | 323/288 |
| 5,777,503 | * | 7/1998 | Faulk | 323/288 |
| 5,818,207 | * | 10/1998 | Hwang | 323/351 |

* cited by examiner

*Primary Examiner*—Jeffrey Sterrett
(74) *Attorney, Agent, or Firm*—Gene Scott-Patent Law & Venture Group

(57) ABSTRACT

An electrical circuit provides a fixed frequency switching regulator, having improved dynamic response, and a low count of external discrete elements. The circuit can be used at 100% duty cycle and does not require a minimum load or the components usually found in such circuits for compensation. A current source is used to charge a timing capacitor. A comparator is used in conjunction with a hysteresis circuit so that as the timing capacitor is charged the voltage on one input of the comparator rises until reaching a set input voltage level whereupon the timing capacitor is discharged to ground. A PWM latch logic element is used to control output to a control switch, a FET, so that positive going output pulses are received at an output terminal. A divider network between the output terminal and the timing capacitor along with a switch controlled by the PWM latch element are used for slope compensation for maintaining operational synchronization to the oscillator.

4 Claims, 3 Drawing Sheets

FIXED FREQUENCY SWITCHING REGULATOR WITH IMPROVED DYNAMIC RESPONSE

BACKGROUND OF THE INVENTION

1. Field of the Invention

This invention relates generally to fixed frequency switching regulators, and more particularly to such a regulator having improved dynamic response, a low count of external discrete elements, can be used at 100% duty cycle, does not require a minimum load, and does not require compensation components.

2. Description of Related Art

The following art defines the present state of this field:

Ghotbi, U.S. Pat. No. 5,233,509 describes an adjustable device with near unity power factor that is achieved while reducing harmonics in a switch-mode power supply by replacing the conventional diode bridge in the front end with an H-bridge driver. Two feedback loops are required, one feedback loop is used to regulate a DC bulk voltage by comparing the DC bulk voltage to a reference voltage and generating an error signal therefrom. A programmable offset is applied to the error signal for adjusting the power factor. A second feedback loop samples and scales the AC input voltage for use as a scaled replica of the input current The actual input current is then compared to the scaled replica current to produce a second error signal. The two error signals are multiplied to determine the desired input current wherein the desired input current follows the AC input voltage. The desired input current is pulse width modulated by a fixed frequency sawtooth waveform for providing switching signals for controlling the H-bridge driver. The H-bridge driver thus operates such that the input current closely follows the AC input voltage and near unity power factor is maintained. A DC-to-DC converter follows the H-Bridge driver using a single feedback loop for regulating desired DC output voltage.

Shelly, U.S. Pat. No. 4,302,803 describes an AC to DC power supply having a multi-channel, flyback inverter output section regulated via a fixed frequency, pulse width modulation controller. The controller directly regulates each channel by regulating an auxiliary channel, whereby the duty cycle of a switching transistor in the flyback inverter section is varied to maintain a constant DC voltage on the auxiliary channel and correspondingly on each output channel.

Harris, U.S. Pat. No. 5,489,831 a pulse width modulation controller particularly useful for a variable speed variable torque electric motor. Inputs to the controller are a desired RPM signal, a motor electrical signal which is a function of the RPM of the rotor of the motor and its angular position relative to the stator, and a torque feed back signal derived from the power phase winding circuits of the motor. The controller produces pulse width modulated power drive signals which are applied to power switches of the power phase winding circuits of the motor to allow electric current to flow through the power phase winding circuits when power phase enable signals produced by the controller sequentially enable the power switch of a power phase winding circuit to do so. The duty cycle of the power drive signals is a function of the difference between the desired and actual RPM of the motor and the torque of the motor. The frequency of the power drive signals is a fixed integral multiple of the frequency of the power phase enable signals over the fill operating range of RPMs of the motor.

Mammano et al., U.S. Pat. No. 5,414,342 a pulse width modulator voltage feedforward circuit which includes a gating circuit for providing a control signal to a charge circuit which charges an integration circuit with a current proportional to an input voltage. The integration circuit provides an output ramp signal waveform having a slope proportional to the input voltage value. The gating circuit also provide a control signal to a discharge circuit, to thus alternately charge and discharge the integration circuit The gating circuit insures that a minimum deadtime for a transformer reset will occur regardless of input voltage variations by preventing a fixed frequency signal provided by an oscillator from beginning a new ramp waveform signal period until the integration circuit is discharged to a minimum reference voltage level.

Green et al., U.S. Pat. No. 5,404,094 describes a method and system of converting a wide range of DC input voltages from a DC power source to a substantially lower regulated DC output voltage. A pulse width modulated (PWM) signal is generated from an applied DC input voltage to obtain a desired regulated DC output voltage. The PWM signal has a fixed frequency and a variable duty cycle. The PWM signal is filtered to provide a DC output voltage proportional to the amount of time the PWM signal spent in the ON or HIGH state. The duty cycle of the PWM signal is controlled based on an error signal generated by comparing an error voltage level that is proportional to the output voltage to a voltage reference. High voltage protection is provided to the controller during the period the PWM signal is in the OFF or LOW state.

The prior art teaches the use of a pulse-width modulated controller for several applications. However, the prior art does not teach that such a controller may be used for controlling a fixed frequency switching regulator. The present invention fulfills these needs and provides further related advantages as described in the following summary.

SUMMARY OF THE INVENTION

The present invention teaches certain benefits in construction and use which give rise to the objectives described below.

The present invention teaches a fixed frequency switching regulator with improved dynamic response. The regulator uses an open loop comparator to set the output voltage. When the output voltage moves above a selected level a state change occurs. The output voltage of the circuit (Vout), is sensed by the open loop comparator rather then by a compensated error amplifier. Slope compensation is provided in order to stabilize the circuit at duty cycles greater then 0.5. The slope compensation is derived from a linear ramp operating between zero volts and Vin, the input voltage level.

The circuit can be used at 100% duty cycle and does not require a minimum load or external loop compensation. A current source is used to charge a timing capacitor. A comparator is used in conjunction with a hysteresis circuit so that as the timing capacitor is charged the voltage on one input of the comparator rises to a set input voltage level whereupon the timing capacitor is discharged to ground. A pulse-width modulated latching controller logic element is used to control output to a control switch, a field-effect transistor, providing positive going output pulses to an output terminal. A divider network between the output terminal and the timing capacitor along with a switch controlled by the PWM latch element are used for slope compensation and for maintaining operational synchronization to the oscillator.

A primary objective of the present invention is to provide a fixed frequency switching regulator with improved dynamic response and other advantages not taught by the prior art.

Another objective is provide such a regulator which requires no minimum load.

A further objective of the present invention is to provide such a regulator which can operate at a 100% duty cycle.

A still further objective of the present invention is to provide such a regulator that requires no compensation components and generally, fewer external components.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE PREFERRED EMBODIMENT

Figure 1:
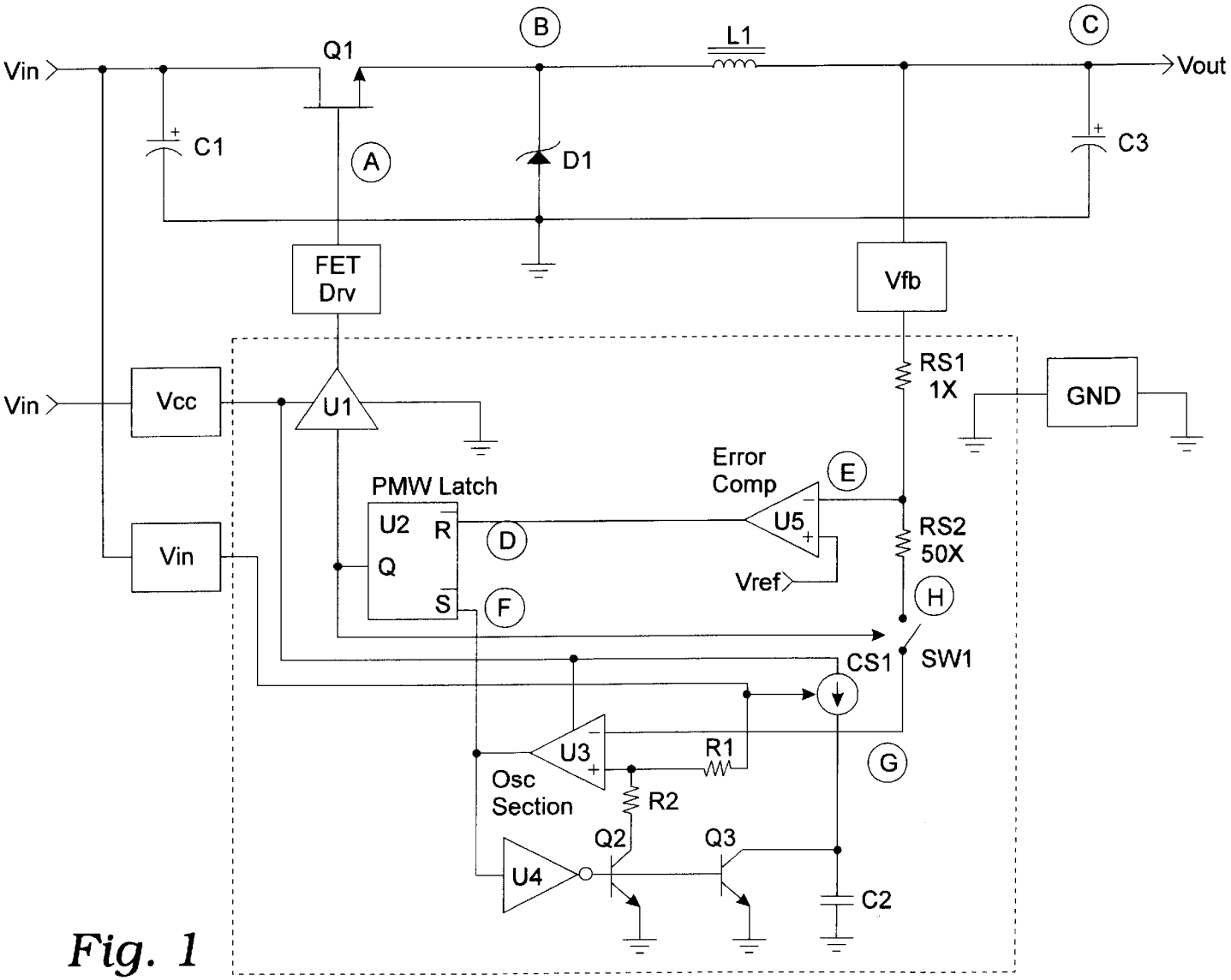
FIG. 1 is an electrical schematic diagram of an embodiment of the present invention showing a preferred manner of making the invention.

The above described drawing figure, FIG. 1 illustrates the preferred embodiment of the present invention in schematic form. The invention is as shown within the dashed line box in FIG. 1 with the input/output circuit containing the FET Q1 being considered as ancillary to the invention. The electrical circuit of the invention operates as a fixed frequency switching regulator comprising electrical circuit elements including an oscillator means having a current source CS1, a comparator U3, a discharge switch Q3, a timing capacitor C2 and a hysteresis circuit R1, R2 and Q2. Certain points "A" through "H" in the circuit of FIG. 1 are referenced to more particularly point out the operation of the circuit and to define the corresponding operating waveforms shown in FIGS. 2 and 3. The circuit elements of the present inventive circuit are common elements presently commercially available. Novelty in the present invention is based upon the specific combination of elements used and in the fact that this combination provides novel and useful operation for achieving the previously stated objectives of the invention. Operation of the circuit is as described in the following description.

Oscillator Section Operation

Initially C2 (G) is at zero volts and is charged by CS1 until the voltage at point (G) exceeds Vin. This causes the output signal of U3 to go low which, in turn, causes the output of U4 to go high thereby turning Q2 and Q3 on. The hysteresis circuit R1, R2 and Q2 develops hysteresis. Q3 quickly discharges C2 back to zero volts and the cycle repeats. The cycle period is calculated as:

$$(C_2 * V_{in})/I_{cs1}$$

Therefore, the cycle period may be lengthened by increasing the value of C2, by increasing the input voltage, or by decreasing the value of the current source CS1. CS1 is modulated by Vin to minimize cycle period variations due to changes at Vin.

Figure 2:
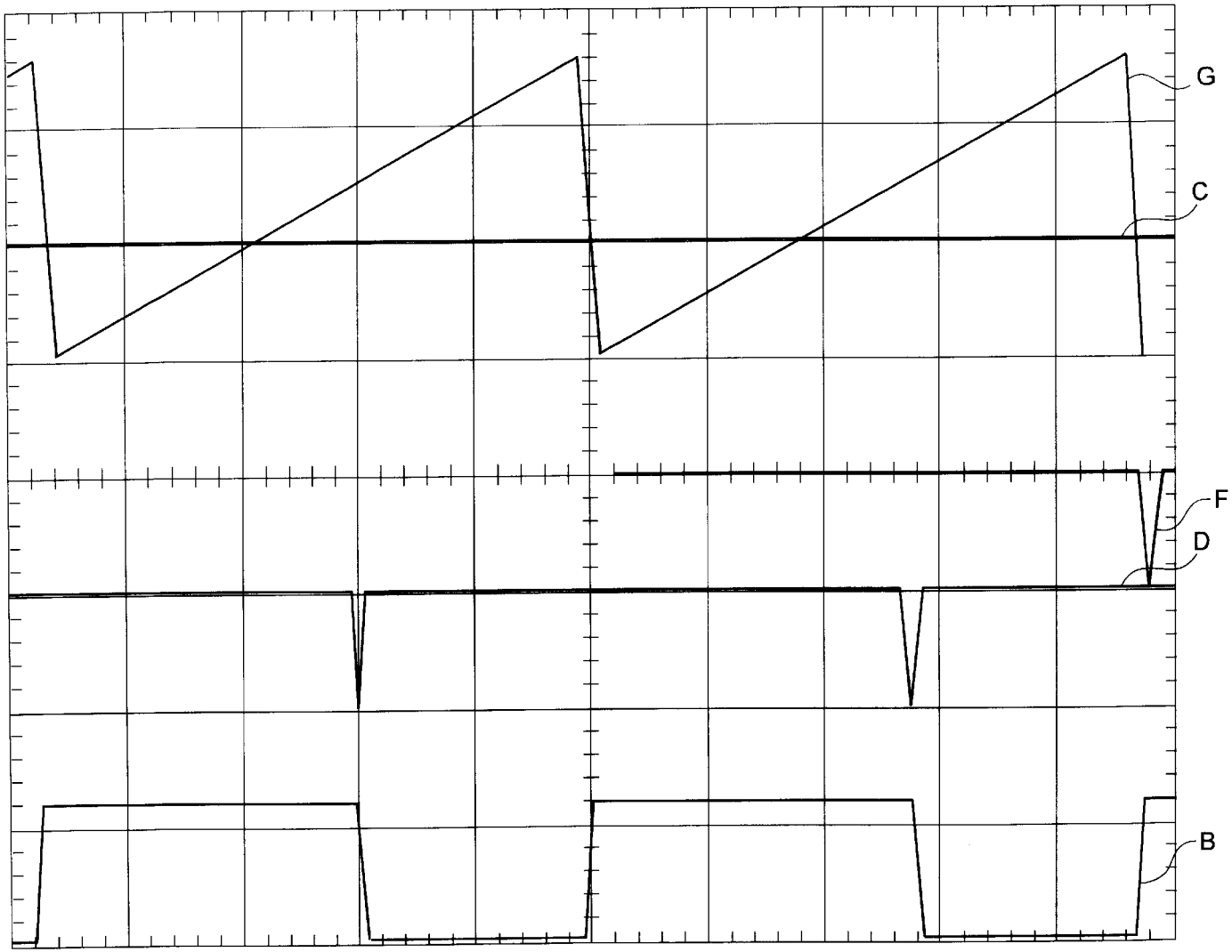
FIG. 2 is a timing diagram comparing smoothed waveforms at points B, C, D, F, and G of FIG. 1, where the horizontal axis is Time and the vertical axis is Voltage Level.
Figure 3:
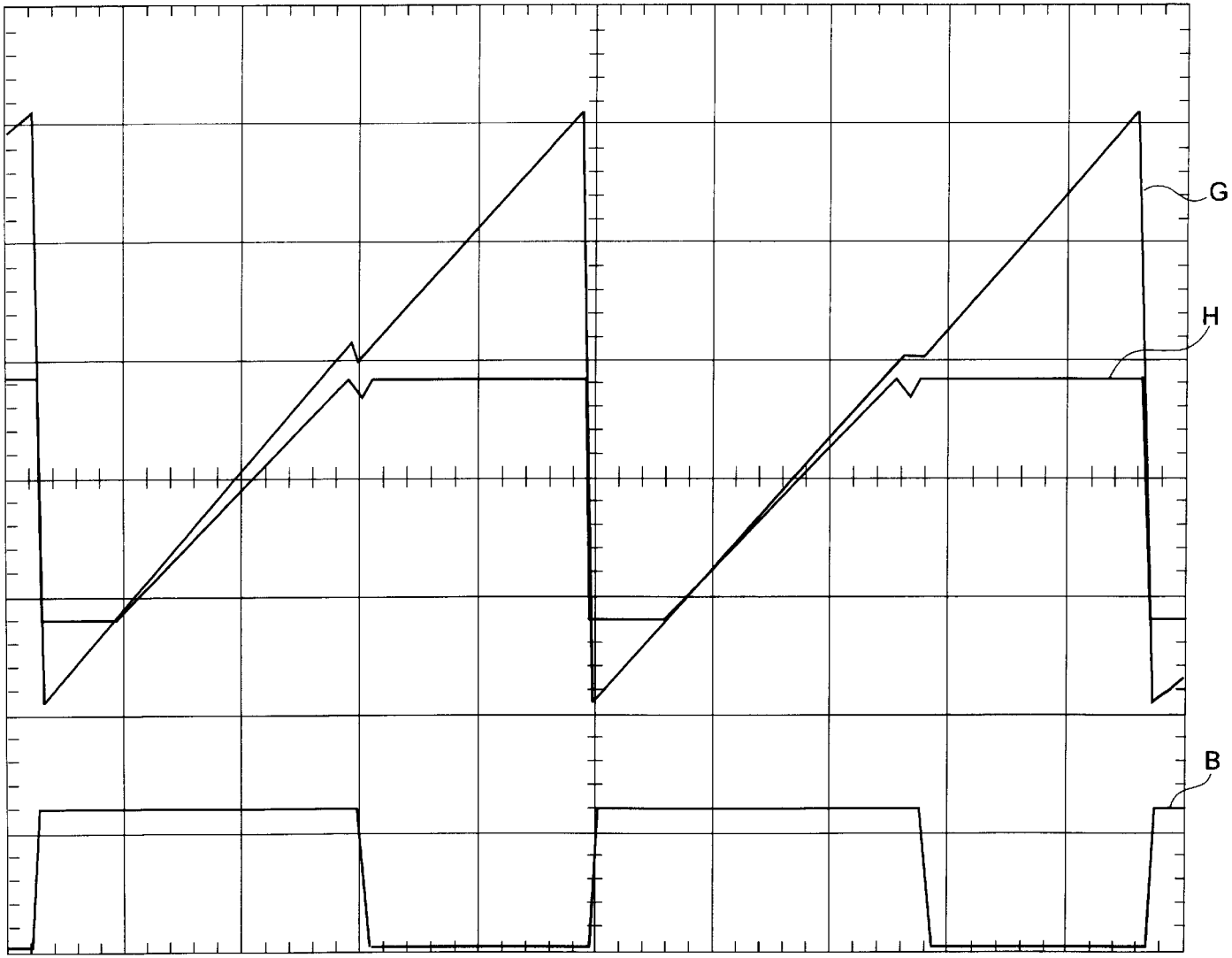
FIG. 3 is a timing diagram similar to that of FIG. 2, comparing smoothed waveforms at points B, G, and H of FIG. 1.

As shown in FIG. 2, the waveform at (G) is a linear up-going ramp as C2 charges, and a fast down-going ramp as C2 discharges through Q3 to ground. The period of the ramp-up is much greater than the period of the ramp-down. The low going pulses from U3 are received at (F), the input of the PWM latch U2. U2 is a reset dominant latch which means that if Set terminal "S" and Reset terminal "R" of U2 are both low, terminal "Q" will also be low.

System Operation

The cycle starts with the Set terminal "S" of U2 going low momentarily, see point (F). This sets terminal "Q" of U2 high, thereby turning on Q1 and closing SW1. We assume here that the Reset terminal "R" of U2 was high, see (D), when "S" went low. Q1 stays on until the voltage at point (E), rises above Vref, that is, until:

$$V_E > V_{REF}$$

Please note that the voltage at (E) is the sum of Vout and the voltage across C2, i.e., point (G). When this condition occurs the output of U5 (D) goes low thereby resetting the PWM latch U2, turning Q1 off, and opening SW1. RS1, RS2 and SW1 couple a portion of the ramp on C2 to point (E) when the "Q" terminal of U2 is high, thereby providing slope compensation for stabilizing operation and providing synchronization with the oscillator means. The fact that the voltage ramp on C2 is linear and moves between zero volts and Vin enables coupling of a major portion of this voltage, at point (G), for error compensation at (E) without introducing significant error in the regulated voltage at the output, point (C). Notice the preferred divider ratio of 50:1 in FIG. 1.

The present invention may may particularly be described as a fixed frequency switching regulator device interconnected for driving an output switch Q1 for enabling an input voltage level Vin at an output terminal, Vout, the device comprising: a current source CS1, a comparator U3, a discharge switch Q3, a timing capacitor C2 and a hysteresis circuit (R1, R2, Q2) interconnected for charging the timing capacitor C2 from the current source CS1 until a timing capacitor voltage level exceeds the input voltage level Vin, so as to enable the comparator U3 to turn on the discharge switch Q3 for draining the timing capacitor C2 so as to drive the comparator U3 into a low state, thereby enabling the hysteresis circuit to develop hysteresis. The device further includes a reset dominant pulse-width modulated latching device U2 having a set "S" and a reset "R" input terminals, the latching device U2 driving an output terminal, "Q" to a low state when both the set and reset input terminals are driven to a low state; the latching device U2 being switched by the comparator U3 so that at the start of a timing cycle, the set input terminal of the latching device U2 assumes a low state when the comparator U3 moves to a low state momentarily so that the output terminal (C) of the latching device moves to a high state thereby turning on the output switch Q1 and enabling feedback from the timing capacitor C2 to an error comparator U5 so that the output switch SW1 remains in an on state until a portion of the output voltage Vout, determined by a voltage divider RS1 & RS2, exceeds a reference voltage Vref at the error comparator U5 so that the latching device U2 turns the output switch SW1 off and disables feedback from the timing capacitor C2.

The voltage divider RS1 & RS2, preferably providing a voltage ratio of approximately fifty to one is preferably coupled to a feedback switch device for enabling a feedback signal from the timing capacitor at the error comparator for providing slope compensation so as to stabilize operation of the device.

A voltage ramp at the timing capacitor is preferably linear from zero volts to Vin, enabling coupling of a portion of the timing capacitor voltage for loop compensation without introducing a significant error at Vout. The current source is preferably modulated by Vin so as to minimize frequency variations due to level changes at Vin.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A fixed frequency switching regulator device interconnected for driving an output switch for enabling an input voltage level at an output terminal, the device comprising: a current source, a comparator, a discharge switch, a timing capacitor and a hysteresis circuit interconnected for; charging the timing capacitor from the current source until a timing capacitor voltage level exceeds the input voltage level, so as to enable the comparator to turn on the discharge switch for draining the timing capacitor so as to drive the comparator into a low state thereby enabling the hysteresis circuit to develop hysteresis; the device further including a reset dominant pulse-width modulated latching device having a set and a reset input terminals, the latching device driving an output terminal to a low state when both the set and reset input terminals are driven to a low state; the latching device being switched by the comparator so that at the start of a timing cycle, the set input terminal of the latching device assumes a low state when the comparator moves to a low state momentarily so that the output terminal of the latching device moves to a high state thereby turning on the output switch and enabling feedback from the timing capacitor to an error comparator so that the output switch remains in an on state until a portion of the output voltage, determined by a voltage divider, exceeds a reference voltage at the error comparator so that the latching device turns the output switch off and disables feedback from the timing capacitor, the voltage divider being coupled to a feedback switch device for enabling a feedback signal from the timing capacitor at the error comparator for providing slope compensation so as to stabilize operation of the device.

2. The device of claim 1 wherein the current source is modulated by the input voltage so as to minimize frequency variations due to level changes at the input voltage.

3. The device of claim 1 wherein the voltage divider provides a voltage ratio of approximately fifty to one.

4. The device of claim 1 wherein a voltage ramp at the timing capacitor is linear from zero volts to the input voltage, enabling coupling of a portion of the timing capacitor voltage for loop compensation without introducing an error at the output voltage.

* * * * *